US007702277B2

(12) United States Patent
Yamauchi et al.

(10) Patent No.: US 7,702,277 B2
(45) Date of Patent: Apr. 20, 2010

(54) IMAGE FORMING APPARATUS AND MAINTENANCE METHOD THEREOF

(75) Inventors: Hirokazu Yamauchi, Uji (JP); Toshiki Takiguchi, Yamato-Koriyama (JP); Kazuhiro Matsuyama, Ikoma (JP); Hiroyuki Murai, Yamato-Koriyama (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 658 days.

(21) Appl. No.: 11/604,844

(22) Filed: Nov. 28, 2006

(65) Prior Publication Data

US 2007/0172243 A1 Jul. 26, 2007

(30) Foreign Application Priority Data

Jan. 23, 2006 (JP) ..... 2006-013906

(51) Int. Cl.
*G03G 15/14* (2006.01)

(52) U.S. Cl. ..... 399/399; 399/16; 399/43; 399/398

(58) Field of Classification Search ..... 399/43, 399/398, 399, 16
See application file for complete search history.

(56) References Cited

FOREIGN PATENT DOCUMENTS

JP 02126275 A * 5/1990
JP 6-27753 A 2/1994
JP 11-219061 A 8/1999
JP 2002-108110 A 4/2002

OTHER PUBLICATIONS

English Abstract JP 02126275A.*

* cited by examiner

*Primary Examiner*—David P Porta
*Assistant Examiner*—Bryan P Ready
(74) *Attorney, Agent, or Firm*—Birch, Stewart, Kolasch & Birch, LLP

(57) ABSTRACT

An image forming apparatus and a maintenance method thereof are provided to enable rotation and replacement of a peeling claw at a suitable timing before the peeling claw is deformed or damaged. Several peeling members are disposed in a width direction of a drum-shaped photoreceptor. Each peeling member is disposed with a peeling claw and a collision sensor detecting that the peeling claw collides with a sheet. A collision history value of each peeling claw is stored and managed based on a collision detection signal from the collision sensor; if the peeling claw reaching a preset rotation request value exists in the read collision history values of the peeling claws, a rotation request of the relevant peeling claw is reported; the collision history value of the rotated peeling claw is rewritten; and if the peeling claw reaching the rotation request value does not exist, a print process is performed.

9 Claims, 7 Drawing Sheets

IMAGE FORMING APPARATUS AND MAINTENANCE METHOD THEREOF

This Nonprovisional application claims priority under 35 U.S.C. §119(a) on Patent Application No. 2006-013906 filed in JAPAN on Jan. 23, 2006, the entire contents of which are hereby incorporated herein by references.

FIELD OF THE INVENTION

The present invention relates to an electrophotographic image forming apparatus including a peeling claw that peels off a conveyed sheet sticking to a photoreceptor after transferring a toner image developed on the drum-shaped photoreceptor that is an electrostatic latent image carrier, and a maintenance method thereof.

BACKGROUND OF THE INVENTION

An electrophotographic image forming apparatus forms a toner image corresponding to image information on a photoreceptor that is an electrostatic latent image carrier to transfer the toner image to a conveyed sheet by the action of a transfer electric field from the backside of the conveyed sheet, and is generally disposed with a sheet peeling means for peeling off from the photoreceptor the conveyed sheet stuck to the photoreceptor after transferring the toner image.

The peeling of the conveyed sheet in the image forming apparatus will specifically be described with reference to FIGS. 1 to 3. FIG. 1 depicts a configuration around a photoreceptor in the image forming apparatus, and the configuration around a drum-shaped photoreceptor 1 rotating in a direction of an arrow A of FIG. 1 includes a development device 2; a transfer charger 3 that applies the transfer electric field from the backside of the sheet; a sheet peeling charger 4 that applies an electric field with a reverse polarity of the electric field of the transfer charger 3 to enhance peeling property; a sheet peeling member 5 including a peeling claw 5*a*; a cleaning unit 6 including a cleaner blade 6*a*; a resist roller 7 for matching a leading edge of the sheet with the image information on the photoreceptor 1; paper guides 8, 9, etc., which are arranged along the rotation direction of the photoreceptor 1 from a position B where exposure laser light is emitted.

In the image forming apparatus with the above configuration, the toner image developed on the surface of the photoreceptor 1 is transferred at a point P1 of FIG. 1 to a sheet P conveyed, and the sheet P is stuck to the photoreceptor 1 due to the transfer electric field applied in this transfer process from the transfer charger 3 and is conveyed in the stuck state by the rotation of the photoreceptor 1. When the stuck sheet P is peeled off from the photoreceptor 1 by applying the electric field with the reverse polarity from the sheet peeling charger 4, the peeled sheet P drops onto the paper guide 9 from the leading edge due to the own weight and smoothly conveyed to the next process.

However, even if the electric field with the reverse polarity is applied by the sheet peeling charger 4, the sheet P is not peeled off from the photoreceptor 1 depending on the material of the sheet P and the image information, and the sheet P not peeled is conveyed while sticking to the photoreceptor 1 and the leading edge collides with the peeling claw 5*a* and is forcibly peeled off.

The sheet peeling member 5 is included for forcibly peeling off the sheet P that is not peeled off and is conveyed in the stuck state even if the electric field with the reverse polarity is applied by the sheet peeling charger 4; for example, as shown in FIG. 2A, an inclined surface X is disposed at a leading end of the peeling claw 5*a*; and an end of a star roller 5*b* is located on an extended line C of the inclined surface X such that the sheet peeled off by the leading end is smoothly separated from the photoreceptor (FIG. 2B).

Describing the mechanism of the sheet peeling with reference to FIG. 3, when the sheet P is stuck to and conveyed by the photoreceptor 1 and the leading edge of the sheet P reaches the leading end of the peeling claw 5*a* (step 1), the leading edge of the sheet P collides with the leading end of the peeling claw 5*a* and the leading edge portion of the sheet P is brought into a stripped-off state (step 2) and runs on the inclined surface X of the peeling claw 5*a* (step 3). When the sheet P is further conveyed by the rotation of the photoreceptor 1, the leading edge of the sheet P reaches the end of the star roller 5*b* (step 4) and, when the sheet P is further conveyed, the sheet P drops and is separated from the photoreceptor 1 due to the own weight (step 5).

By the way, if the developed toner image is transferred to the conveyed sheet with the use of the transfer electric field, a white portion (portion without image information) of the conveyed sheet receives the strong electric field from the transfer charger and is strongly stuck to the photoreceptor. Generally, in the case of a print sheet, the leading edge of the sheet often becomes the white portion and this portion is referred to as a "void area". The void area has a function useful for preventing the entanglement jam of the sheet, which occurs if toner reaches the leading edge of the sheet when melting/fixing is performed for the sheet by a thermal fixing device after the transfer process is completed.

However, the void area often sticks to the photoreceptor as above and this is partially the reason why an electrophotographic image forming apparatus generally employs a configuration with the sheet peeling member including the peeling claw for returning the sticking sheet to a sheet conveying route.

If the sheet peeling member including the peeling claw is not disposed, the strongly sticking sheet P is not peeled off from the photoreceptor 1, is conveyed around the photoreceptor 1 while sticking to the photoreceptor 1, reaches the cleaning unit 6, a main charger (not shown), and the development device 2, which are arranged around the photoreceptor 1, to destroy the apparatus or to damage the photoreceptor surface, and causes deterioration of the print quality as well as reduction of the life property of each unit.

In technologies proposed for preventing the peeling jam from frequently occurring due to shape deformation or damage of the peeling claw leading end in the image forming apparatus disposed with the sheet peeling member, the peeling claw can be contacted with and separated from the photoreceptor depending on the presence of the conveyed sheet and the timing when the sheet leading edge reaches the peeling claw, as in Japanese Laid-Open Patent Publication Nos. H6-27753 and 2002-108110.

However, it is inevitable in any case that the peeling claw repeatedly collides with the sheet leading edge and that the leading end of the claw is deformed or damaged, and if the leading end is deformed or damaged, the sheet sticking to the photoreceptor cannot certainly be peeled off, which frequently causes the peeling jam.

SUMMARY OF THE INVENTION

An object of the present invention is to provide an image forming apparatus that enables rotation and replacement of a peeling claw at a suitable timing before the peeling claw is deformed or damaged, and a maintenance method thereof.

Another object of the present invention is to provide an image forming apparatus disposed with a plurality of sheet peeling members including peeling claws for peeling off a conveyed sheet sticking to a surface of a photoreceptor, the sheet peeling members being arranged in the width direction of the photoreceptor, the apparatus comprising: a collision sensor attached to each sheet peeling member to detect that the conveyed sheet collides with the peeling claw; a collision history value storing/managing portion that stores/manages a collision history value of each peeling claw based on a collision detection signal from the collision sensor; an output portion that outputs a report signal for reporting information about a time of replacement of the peeling claws; and a controlling portion that outputs to the output portion a report signal for reporting a rotation request for the peeling claw with the collision history value reaching a preset setting value, based on the collision history values of the peeling claws stored in the collision history value storing/managing portion.

Another object of the present invention is to provide the image forming apparatus, wherein when the rotation of the peeling claws is performed, the controlling portion rewrites the collision history value stored in the collision history value storing/managing portion for each peeling claw at relevant locations.

Another object of the present invention is to provide the image forming apparatus, wherein the controlling portion outputs to the output portion a report signal for reporting a replacement request for the peeling claw with the collision history value reaching a preset replacement request value.

Another object of the present invention is to provide the image forming apparatus, wherein if the peeling claw is replaced, the controlling portion initializes the collision history value stored in the collision history value storing/managing portion for the peeling claw at the relevant location.

Another object of the present invention is to provide the image forming apparatus, wherein the controlling portion checks whether the collision history value of each peeling claw reaches each of the setting values at least for each job.

Another object of the present invention is to provide the image forming apparatus, wherein the peeling claw is detachably attached to the sheet peeling member.

Another object of the present invention is to provide the image forming apparatus, wherein the collision sensor is a vibration sensor.

Another object of the present invention is to provide a maintenance method of an image forming apparatus including a plurality of sheet peeling members arranged in a width direction of a photoreceptor, the sheet peeling members including peeling claws for peeling off a conveyed sheet sticking to a surface of the photoreceptor, a collision sensor attached to each sheet peeling member to detect that the conveyed sheet collides with the peeling claw, a collision history value storing/managing portion that stores/manages a collision history value of each peeling claw based on a collision detection signal from the collision sensor, an output portion that outputs a report signal for reporting information about a time of replacement of the peeling claws, and a controlling portion, the method comprising the steps of: reading the collision history value stored in the collision history value storing/managing portion for each peeling claw in accordance with a print request; reporting a rotation request of the relevant peeling claw if the peeling claw reaching a preset rotation request value exists in the read collision history values of the peeling claws; rewriting the collision history value of the relevant peeling claw if the rotation of the peeling claw is performed based on the rotation request; and performing a print process if the peeling claw reaching the rotation request value does not exist in the collision history values read from the collision history value storing/managing portion for each peeling claw.

Another object of the present invention is to provide the maintenance method comprising the steps of reporting a replacement request of the relevant peeling claw if the peeling claw reaching a preset replacement request value exists in the read collision history values of the peeling claws; and rewriting the collision history value of the relevant peeling claw if the peeling claw is replaced based on the replacement request.

PREFERRED EMBODIMENTS OF THE INVENTION

Figure 1:
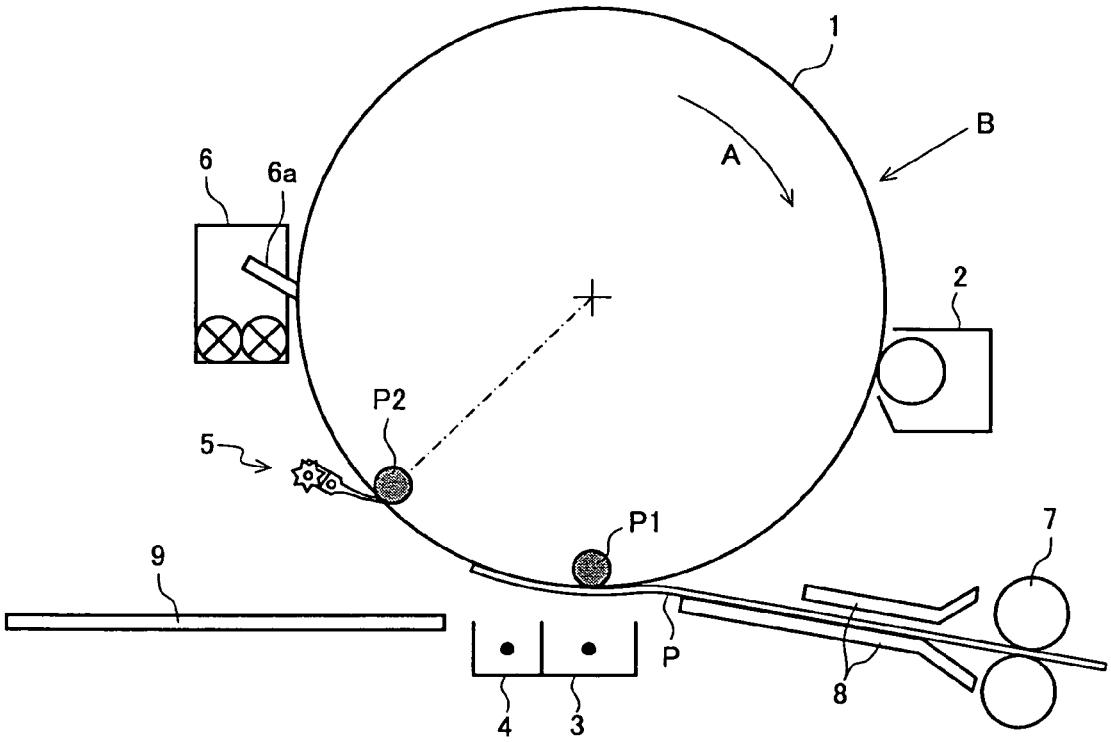
FIG. 1 depicts a periphery of a photoreceptor disposed with a conventional peeling claw.
Figure 2A:
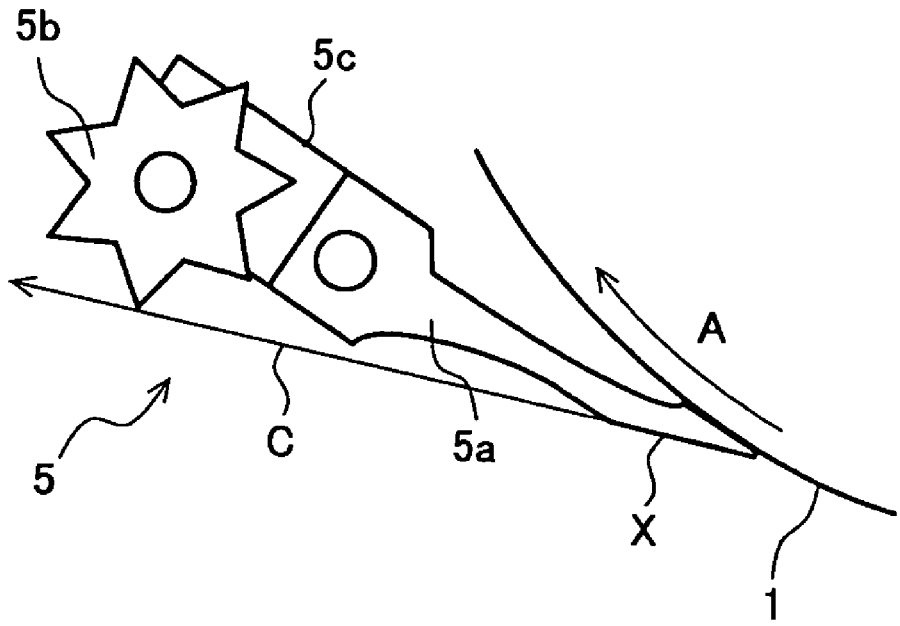
FIGS. 2A and 2B are explanatory views of a sheet peeling member.
Figure 2B:
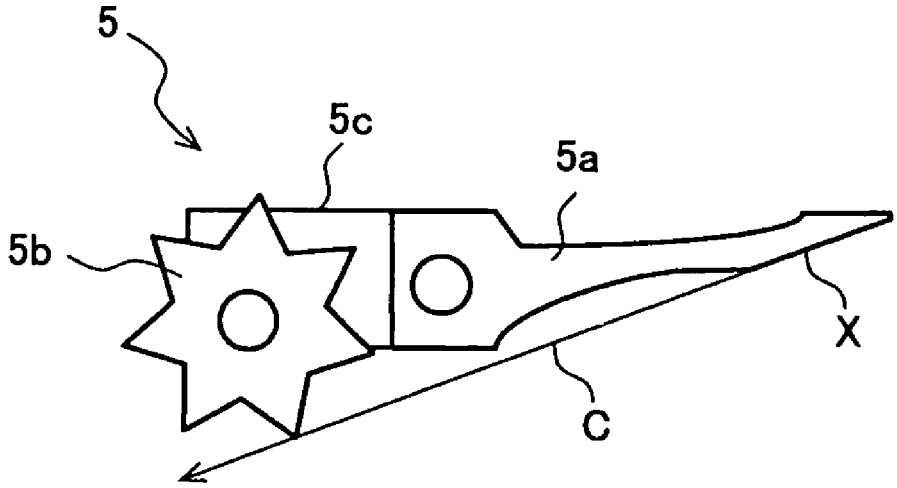
Figure 3:
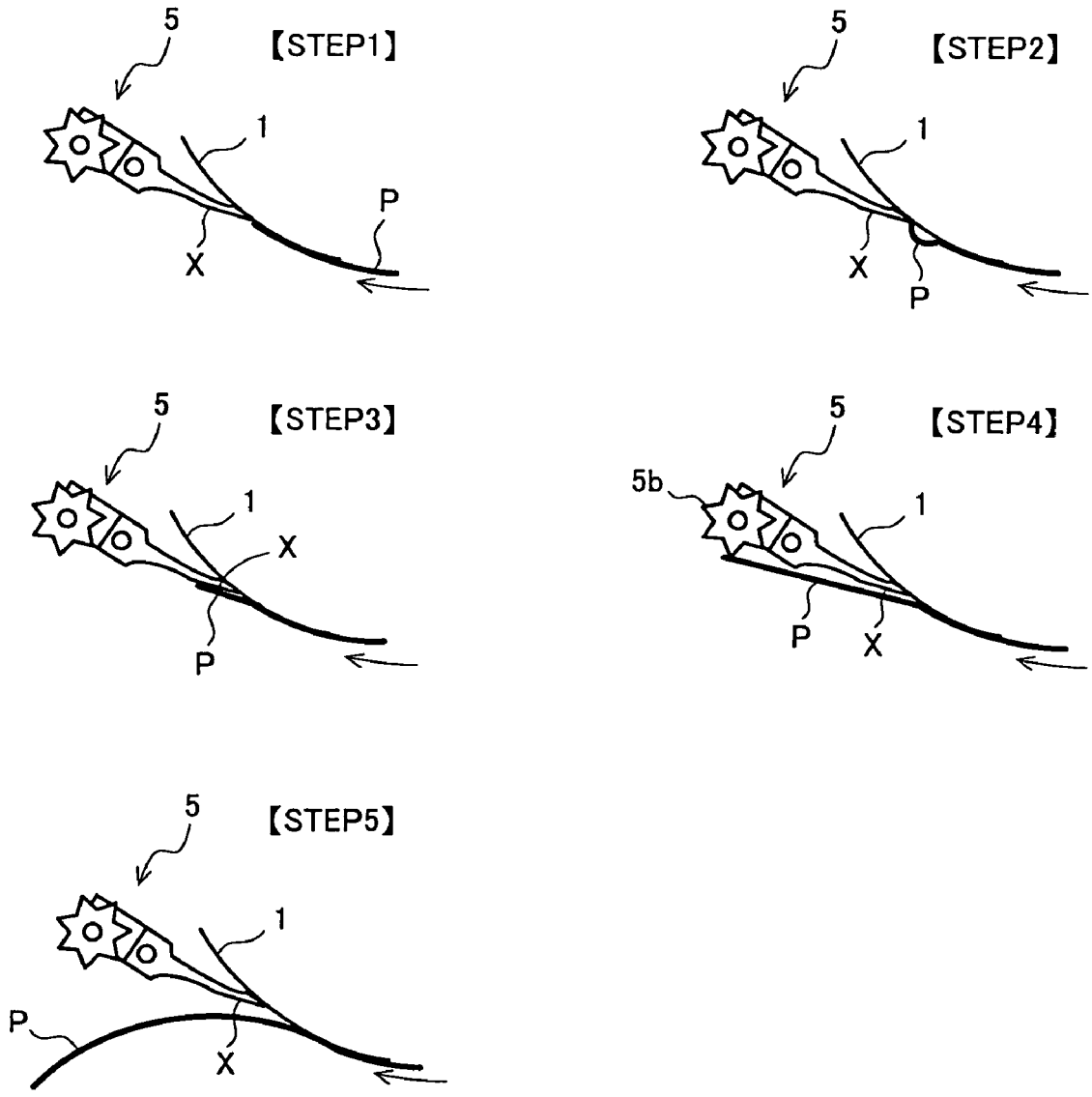
FIG. 3 is an explanatory view of a mechanism of peeling off a sticking sheet with the peeling claw from the photoreceptor.
Figure 4:
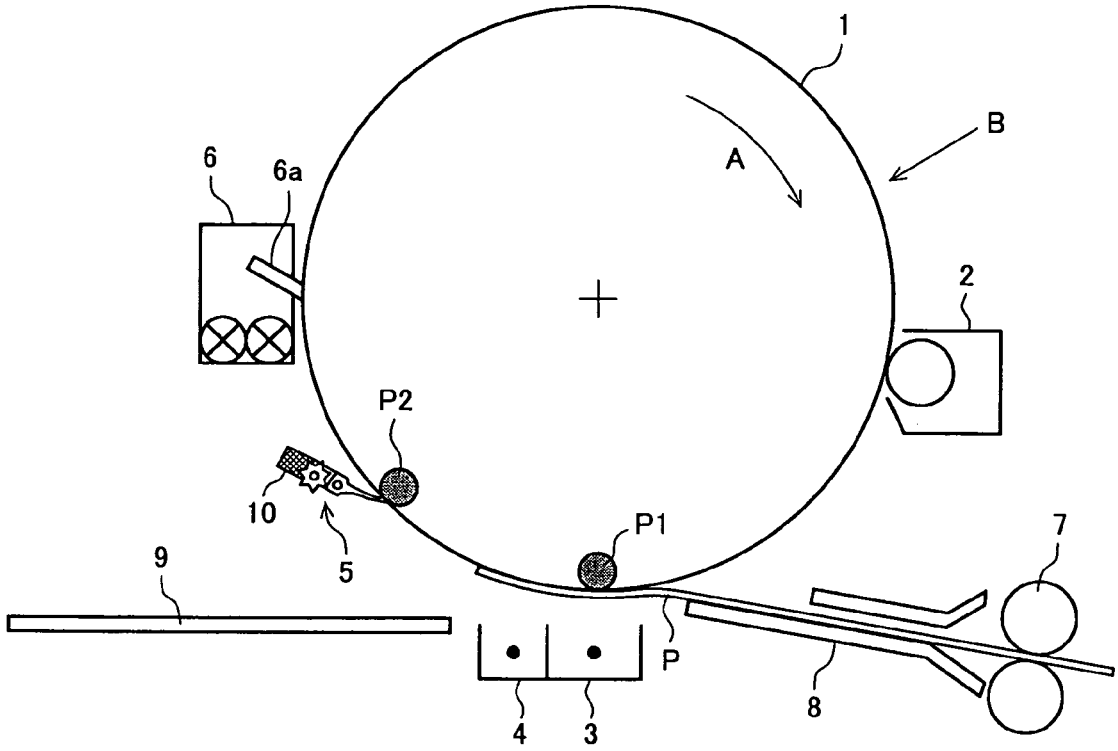
FIG. 4 depicts a periphery of a photoreceptor disposed with a sheet peeling member including a collision sensor, according to an embodiment of the present invention.
Figure 5:
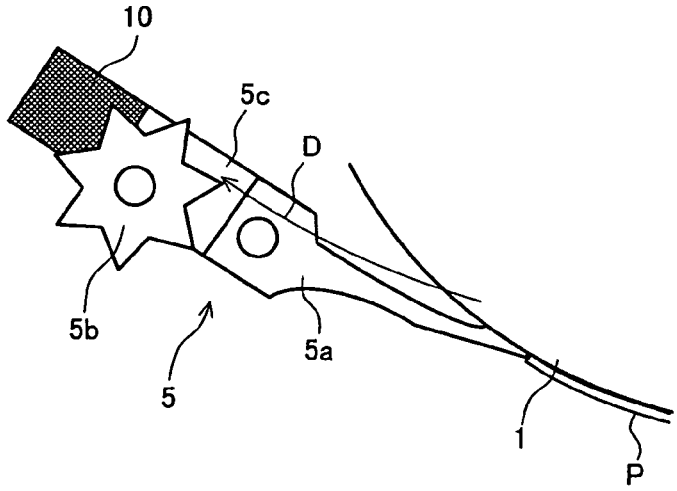
FIG. 5 is an enlarged view of the sheet peeling member including the collision sensor, according to an embodiment of the present invention.
Figure 6:
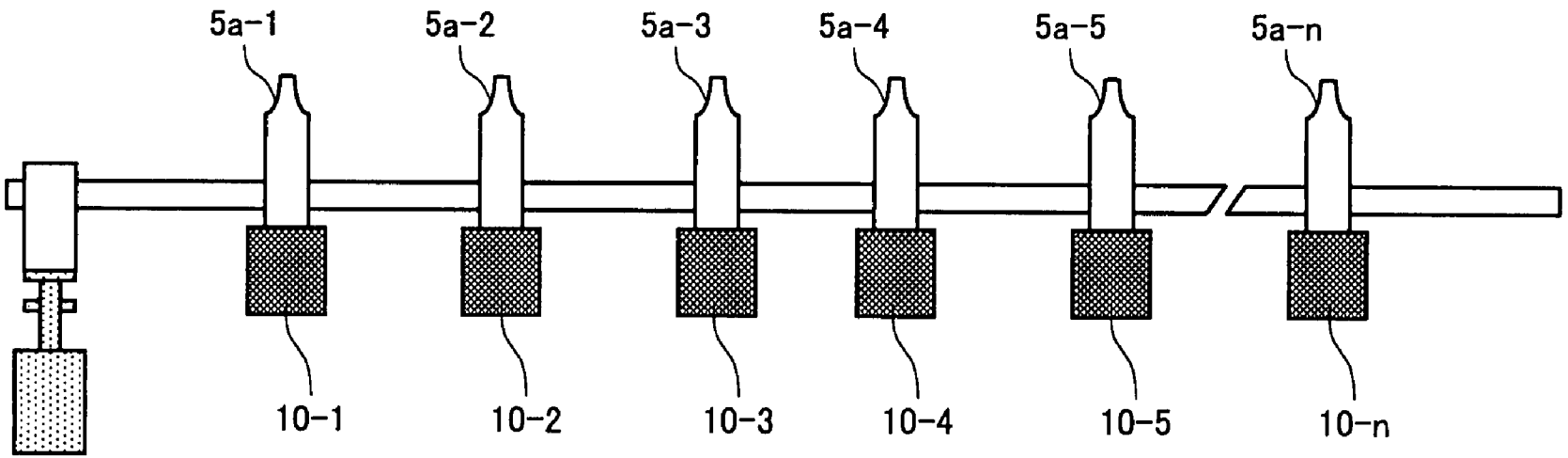
FIG. 6 depicts peeling claws including the collision sensors arranged in a width direction of the photoreceptor, according to an embodiment of the present invention.

An embodiment of the present invention will hereinafter be described with reference to the drawings. FIG. 4 depicts an embodiment of the present invention, and a collision sensor 10 detects that a sheet P collides with a peeling claw 5*a* and is attached to an attachment member 5*c* of a sheet peeling member 5 as shown in FIG. 5 to detect an impact force in a direction of an arrow D, which is generated when the sheet P collides with the peeling claw 5*a*. The collision sensor can be a vibration sensor, for example. As shown in FIG. 6, collision sensors 10-1, 10-2, 10-3, . . . 10-n are attached to a plurality of peeling claws 5*a*-1, 5*a*-2, 5*a*-3, . . . 5*a*-n, which are arranged in a width direction of a drum-shaped photoreceptor 1.

Figure 7:
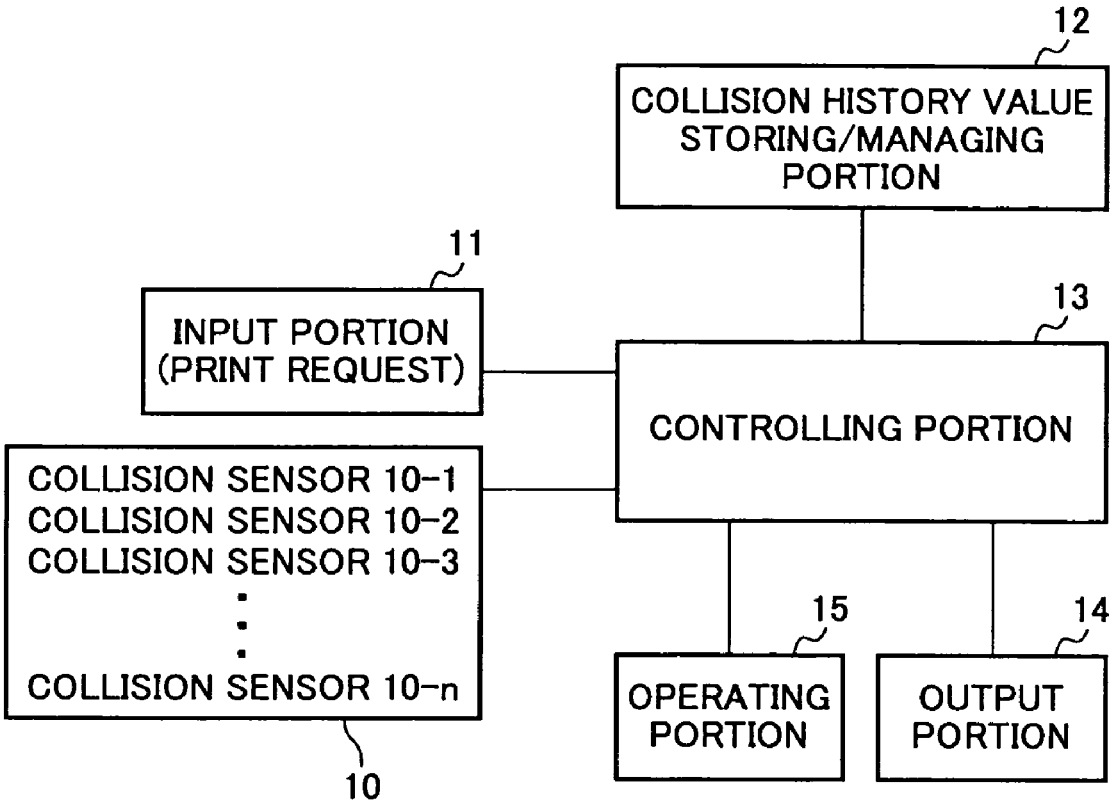
FIG. 7 is a block configuration diagram of an image forming apparatus according to an embodiment of the present invention.

FIG. 7 is a block configuration diagram of an image forming apparatus of the present invention; reference numeral 10 designates a sensor circuit that sends to a controlling portion 13 a detection signal of the collision sensor detecting the collision of the sheet; reference numeral 11 designates an input portion that sends information of a print request, if any, to the controlling portion 13; reference numeral 12 designates a collision history value storing/managing portion that stores/manages a collision history value of each peeling claw based on the collision detection signals from the collision sensors 10-2, 10-3, . . . 10-n; reference numeral 14 designates an output portion that reports a rotation request or a replacement request of the peeling claws; and reference numeral 15 designates an operating portion used by a user for inputting, for example, location number information of the relevant peeling claw when rotating or replacing the peeling claw.

Figure 8:
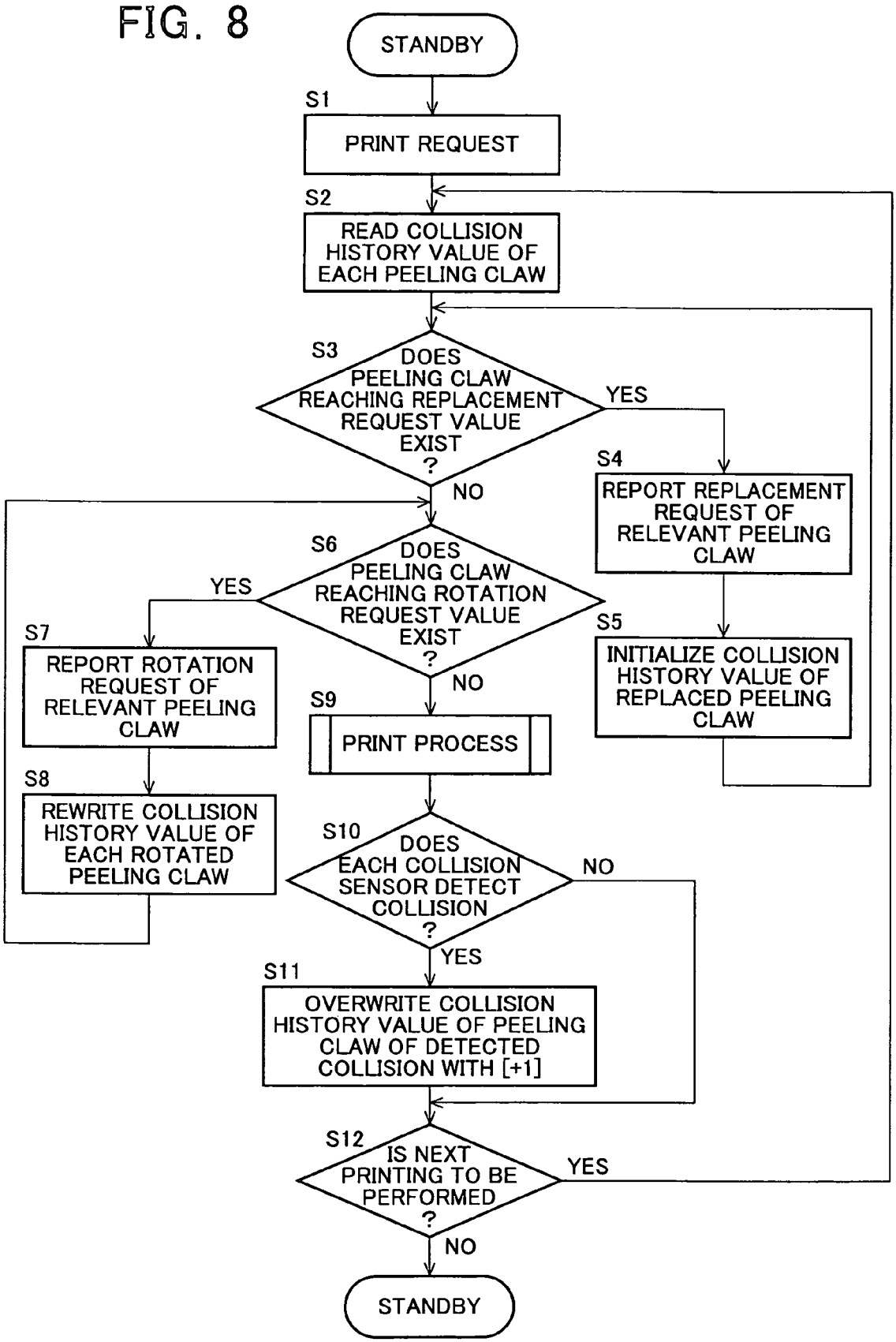
FIG. 8 is an explanatory flowchart of a maintenance method according to an embodiment of the present invention.

A maintenance method of the peeling claws according to the present invention will specifically be described with reference to a flowchart of FIG. 8. If a print request is generated in the image forming apparatus in a standby state (step S1), a collision history value of each peeling claw is read out which is stored in the collision history value storing/managing portion 12 (step S2); it is checked whether the peeling claw exists which has a collision history value reaching a replacement request value (step S3); if the peeling claw reaching the replacement request value exists (step S3/YES), a replacement request of the relevant peeling claw is reported (step S4); if the peeling claw is replaced in accordance with the replacement request, the collision history value of the replaced peeling claw is initialized (step S5); and the procedure goes back to step S3. If the peeling claw reaching the replacement request value does not exist, the procedure goes to step S6 to check whether the peeling claw reaching a rotation request value exists (step S6); if the peeling claw reaching a rotation request value exists (step S6/YES), the rotation of the peeling claw is performed with a peeling claw having the least collision history value (step S7); the collision history values are rewritten for the peeling claws of the rotated location numbers (step S8); and the procedure goes back to step S6.

If the peeling claw reaching the rotation request value does not exist at step S6, the procedure goes to step S9 to perform a print process. After the print process is completed, the procedure goes to step S10; if a collision sensor detecting a collision exists, the procedure goes to step S11 to overwrite the collision history value of the peeling claw of the detected collision with [+1]; the procedure goes to step S12; if the next printing is to be performed, the procedure goes back to step S2; and if the next printing is not to be performed, the apparatus is put into the standby state.

For example, if the rotation is performed when the number of times of collisions reaches 1000 and the peeling claw is replaced with new one when the number of times of collisions reaches 10000, the replacement request value is 10000; the rotation request value is 1000, 2000, 3000, etc., which arise every 1000 times; and if the collision history value reaches 10000, the replacement request is reported.

The peeling claws are arranged at certain intervals in the width direction of the photoreceptor and, if the apparatus supports three sheet sizes that are B4, A4, and B5, the number of times of the sheet collisions varies considerably between the peeling claw located near the center and the peeling claw located near the end depending on the used sheet size. Therefore, the efficient and rational maintenance of the peeling claws can easily be performed by reporting the time of the rotation of the peeling claws with the method of the embodiment.

According to the present invention, since the suitable time of rotation and replacement of the peeling claws can be easily known, the peeling jam can be prevented from frequently occurring.

The invention claimed is:

1. An image forming apparatus disposed with a plurality of sheet peeling members each including peeling claws for peeling off a conveyed sheet sticking to a surface of a photoreceptor, the sheet peeling members being arranged along a width direction of the photoreceptor, the apparatus comprising:

a collision sensor attached to each sheet peeling member to detect that the conveyed sheet collides with the peeling claw; a collision history value storing/managing portion that stores/manages a collision history value of each peeling claw based on a collision detection signal from the collision sensor; an output portion that outputs a report signal for reporting information about a time of replacement of the peeling claws; and a controlling portion that outputs to the output portion a report signal for reporting a rotation request for the peeling claw with the collision history value reaching a preset setting value, based on the collision history values of the peeling claws stored in the collision history value storing/managing portion.

2. The image forming apparatus of claim 1, wherein when the rotation of the peeling claws is performed, the controlling portion rewrites the collision history value stored in the collision history value storing/managing portion for each peeling claw at relevant locations.

3. The image forming apparatus of claim 2, wherein the controlling portion outputs to the output portion a report signal for reporting a replacement request for the peeling claw with the collision history value reaching a preset replacement request value.

4. The image forming apparatus of claim 3, wherein if the peeling claw is replaced, the controlling portion initializes the collision history value stored in the collision history value storing/managing portion for the peeling claw at the relevant location.

5. The image forming apparatus of claim 1, wherein the controlling portion checks whether the collision history value of each peeling claw reaches each of said preset setting value for rotation request and a preset setting value for replacement of said peeling claws at least for each job.

6. The image forming apparatus of claim 1, wherein the peeling claw is detachably attached to the sheet peeling member.

7. The image forming apparatus of claim 1, wherein the collision sensor is a vibration sensor.

8. A maintenance method of an image forming apparatus including a plurality of sheet peeling members arranged in a width direction of a photoreceptor, the sheet peeling members including peeling claws for peeling off a conveyed sheet sticking to a surface of the photoreceptor, a collision sensor attached to each sheet peeling member to detect that the conveyed sheet collides with the peeling claw, a collision history value storing/managing portion that stores/manages a collision history value of each peeling claw based on a collision detection signal from the collision sensor, an output portion that outputs a report signal for reporting information about a time of replacement of the peeling claws, and a controlling portion, the method comprising the steps of:

reading the collision history value stored in the collision history value storing/managing portion for each peeling claw in accordance with a print request;

reporting a rotation request of the relevant peeling claw if the peeling claw reaching a preset rotation request value exists in the read collision history values of the peeling claws;

rewriting the collision history value of the relevant peeling claw if the rotation of the peeling claw is performed based on the rotation request; and performing a print process if the peeling claw reaching the rotation request value does not exist in the collision history values read from the collision history value storing/managing portion for each peeling claw.

9. The maintenance method of an image forming apparatus of claim 8, comprising the steps of:

reporting a replacement request of the relevant peeling claw if the peeling claw reaching a preset replacement request value exists in the read collision history values of the peeling claws; and rewriting the collision history value of the relevant peeling claw if the peeling claw is replaced based on the replacement request.

* * * * *